US008439160B2

(12) United States Patent
Kolaini et al.

(10) Patent No.: US 8,439,160 B2
(45) Date of Patent: May 14, 2013

(54) ACOUSTIC SUPPRESSION SYSTEMS AND RELATED METHODS

(75) Inventors: Ali R. Kolaini, Encino, CA (US); Dennis L. Kern, Lomita, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 13/290,004

(22) Filed: Nov. 4, 2011

(65) Prior Publication Data

US 2012/0273295 A1 Nov. 1, 2012

Related U.S. Application Data

(60) Provisional application No. 61/411,799, filed on Nov. 9, 2010, provisional application No. 61/537,544, filed on Sep. 21, 2011.

(51) Int. Cl.
*E04B 1/82* (2006.01)

(52) U.S. Cl.
USPC ..... 181/288; 181/284; 181/286

(58) Field of Classification Search ..... 181/284, 181/288, 286
See application file for complete search history.

(56) References Cited

U.S. PATENT DOCUMENTS

| | | | | |
|---|---|---|---|---|
| 4,430,286 | A * | 2/1984 | Franz | 264/258 |
| 4,663,385 | A | 5/1987 | Chang et al. | |
| 5,475,882 | A | 12/1995 | Sereboff | |
| 5,507,886 | A | 4/1996 | Drew et al. | |
| 5,590,430 | A | 1/1997 | Sereboff | |
| 5,713,544 | A | 2/1998 | Wolf et al. | |
| 5,824,148 | A | 10/1998 | Cornwell | |
| 5,869,164 | A | 2/1999 | Nickerson et al. | |
| 6,046,255 | A * | 4/2000 | Gray et al. | 523/218 |
| 6,090,478 | A * | 7/2000 | Nishizaki et al. | 428/297.4 |
| 6,237,598 | B1 | 5/2001 | Sereboff | |
| 6,347,411 | B1 | 2/2002 | Darling | |
| 6,443,258 | B1 | 9/2002 | Putt et al. | |
| 6,509,385 | B2 | 1/2003 | Sereboff | |
| 6,598,358 | B1 | 7/2003 | Schwertfeger et al. | |
| 6,626,403 | B1 | 9/2003 | Wolf et al. | |
| 7,654,364 | B2 | 2/2010 | Yamaguchi et al. | |
| 7,754,791 | B2 | 7/2010 | Sereboff et al. | |

(Continued)

FOREIGN PATENT DOCUMENTS

JP 2001-080008 3/2001

OTHER PUBLICATIONS

PCT International Search Report mailed on Jun. 26, 2012 for PCT Application No. PCT/US2011/059457 filed on Nov. 4, 2011 in the name of California Institute of Technology et al.

(Continued)

*Primary Examiner* — Forrest M Phillips
(74) *Attorney, Agent, or Firm* — Steinfl & Bruno LLP

(57) ABSTRACT

An acoustic suppression system for absorbing and/or scattering acoustic energy comprising a plurality of acoustic targets in a containment is described, the acoustic targets configured to have resonance frequencies allowing the targets to be excited by incoming acoustic waves, the resonance frequencies being adjustable to suppress acoustic energy in a set frequency range. Methods for fabricating and implementing the acoustic suppression system are also provided.

26 Claims, 4 Drawing Sheets

U.S. PATENT DOCUMENTS

| | | | | |
|---|---|---|---|---|
| 7,783,481 | B2 | 8/2010 | Endo et al. | |
| 7,811,525 | B2 | 10/2010 | Laugharn, Jr. et al. | |
| 8,276,710 | B2 * | 10/2012 | Soltau et al. | 181/294 |
| 2001/0050196 | A1 | 12/2001 | Okada et al. | |
| 2003/0190453 | A1 | 10/2003 | Sereboff | |
| 2004/0131836 | A1 | 7/2004 | Thompson | |
| 2005/0086823 | A1 | 4/2005 | Subramonian et al. | |
| 2005/0100728 | A1 | 5/2005 | Ristic-Lehmann et al. | |
| 2006/0175723 | A1 | 8/2006 | Butler et al. | |
| 2009/0076179 | A1 * | 3/2009 | Sugawara et al. | 521/81 |
| 2010/0272983 | A1 * | 10/2010 | Thouilleux et al. | 428/318.4 |
| 2011/0057144 | A1 | 3/2011 | Schoenfeld et al. | |

OTHER PUBLICATIONS

PCT Written Opinion mailed on Jun. 26, 2012 for PCT Application No. PCT/US2011/059457 filled on Nov. 4, 2011 in the name of California Institute of Technology et al.

Properetti, A., A model of bubbly liquid, J. Wave-Mat. Int. 1986, 413-432.

Pierce, A. Acoustics: An introduction to its physical principles and applications, Acoustical Society of America, 1991, p. 130-133.

Arenas, Jorge P. et al. Recent Trends in Porous Sound-Absorbing Materials. Sound and Vibration Mag. 12-17. Jul. 2010.

* cited by examiner

ACOUSTIC SUPPRESSION SYSTEMS AND RELATED METHODS

CROSS REFERENCE TO RELATED APPLICATIONS

The present application claims priority to U.S. Provisional Application No. 61/411,799, filed on Nov. 9, 2010, and to U.S. Provisional Application No. 61/537,544 filed on Sep. 21, 2011, both of which are incorporated herein by reference in their entirety.

STATEMENT OF GOVERNMENT GRANT

The invention described herein was made in the performance of work under a NASA contract, and is subject to the provisions of Public Law 96-517 (35 USC 202) in which the Contractor has elected to retain title.

FIELD

The present disclosure relates to acoustic suppression systems. In particular, it relates to an acoustic suppression system and methods for suppressing acoustic energy.

SUMMARY

According to a first aspect of the disclosure, an acoustic suppression system is described, comprising a containment, in which a plurality of acoustic targets are enclosed, wherein: each acoustic target comprises a substrate material encapsulating a gas, each acoustic target is configured to have a resonance frequency allowing the target to be excited by incoming acoustic waves, and resonance frequencies of the plurality of targets are adjustable to suppress acoustic energy in a set frequency range.

According to a second aspect of the disclosure, a method for fabricating an acoustic suppression system is described, the method comprising placing acoustic targets in a containment, wherein: each acoustic target comprises a substrate material encapsulating a gas, each acoustic target is configured to have a resonance frequency allowing the target to be excited by incoming acoustic waves, and resonance frequencies of the plurality of targets are adjustable to suppress acoustic energy in a set frequency range.

According to a third aspect of the disclosure, a method for suppressing acoustic energy is described, the method comprising positioning acoustic suppression systems in areas in which acoustic suppression is desired, the acoustic suppression systems each comprising a containment, in which a plurality of acoustic targets are enclosed, wherein: each acoustic target comprises a substrate material encapsulating a gas, each acoustic target is configured to have a resonance frequency allowing the target to be excited by incoming acoustic waves, and resonance frequencies of the plurality of targets are adjustable to suppress acoustic energy in a set frequency range.

According to a fourth aspect of the disclosure, a method for suppressing acoustic energy is described, the method comprising stuffing acoustic targets and/or acoustic suppression systems in walls, doors, ceilings, floors, or other structures for which acoustic suppression is desired, wherein: each acoustic target comprises a substrate material encapsulating a gas, each acoustic target is configured to have a resonance frequency allowing the target to be excited by incoming acoustic waves, and resonance frequencies of the plurality of targets are adjustable to suppress acoustic energy in a set frequency range.

The details of one or more embodiments of the disclosure are set forth in the accompanying drawings and the description below. Other features, objects, and advantages will be apparent from the description and drawings, and from the claims.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DETAILED DESCRIPTION

Figure 1:
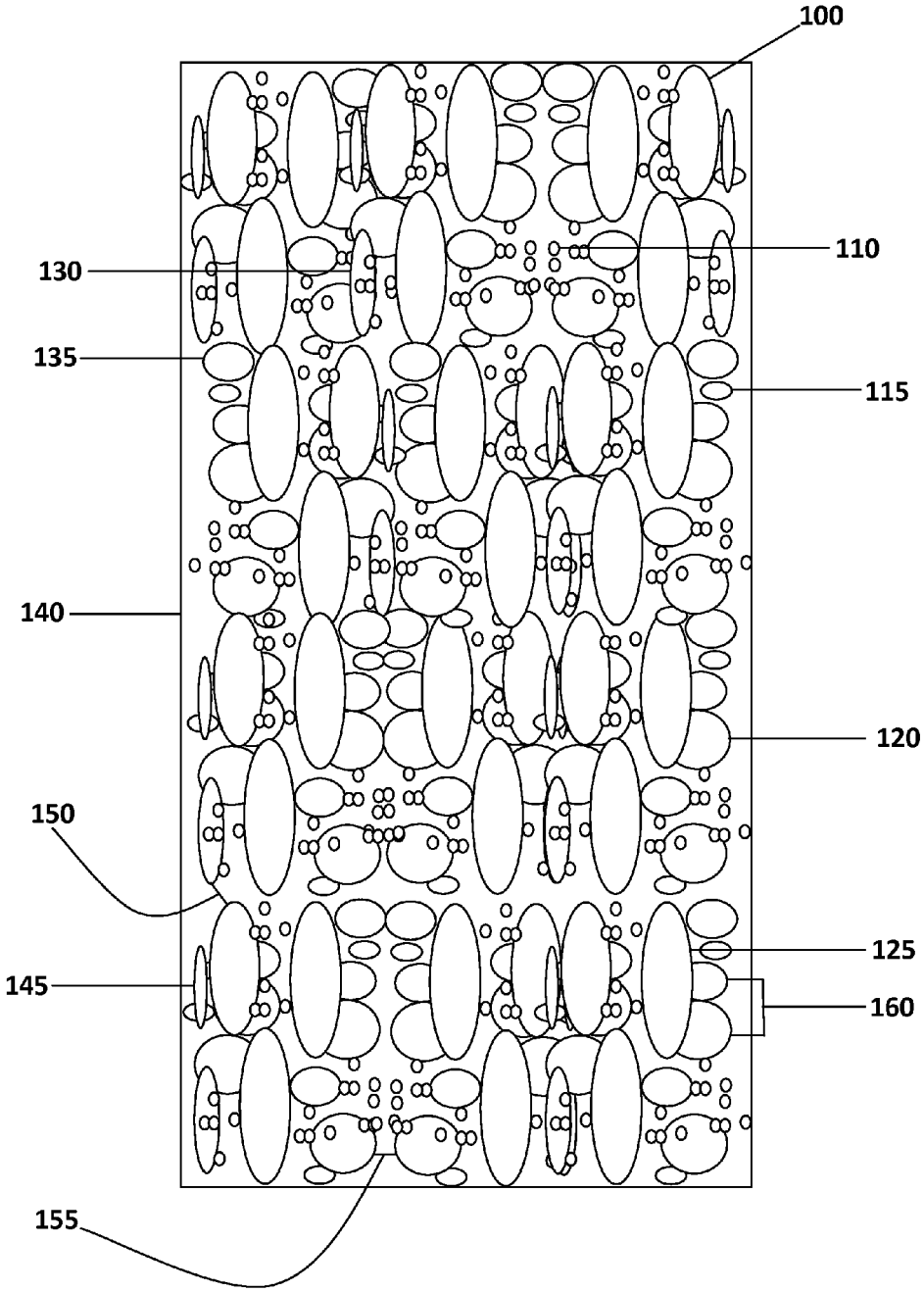
FIG. 1 shows a front-view schematic of an acoustic suppression system according to some embodiments herein described.

The term "acoustic absorption" as used herein is defined to mean a process of converting acoustic energy of given frequency bands into other forms of energy, including but not limited to, heat energy.

The term "acoustic scattering" as used herein is defined to mean a process of reflecting acoustic energy of given frequency bands away from a targeted structure.

The term "acoustic suppression" as used herein is defined to mean at least acoustic absorption and/or acoustic scattering.

The term "acoustic transmission" as used herein is defined to mean acoustic energy that may pass through or be transferred/transmitted through a substance.

The terms "acoustic target" and "bubble" as used herein are defined to mean an object that may absorb acoustic/sound energy and convert it to heat energy and/or scatter the acoustic/sound energy. For example, an acoustic target and/or bubble may include, but is not limited to, a substrate material encapsulating a gas.

The term "acoustic suppression system" as used herein is defined to mean an arrangement comprising a plurality of acoustic targets that are used to suppress acoustic energy, i.e. to absorb acoustic energy and convert it to heat energy and/or to scatter acoustic energy away from a targeted structure.

The terms "substrate" and "substrate material" as used herein are defined to mean a material that is used to encapsulate a gas. For example, an acoustic target comprises a substrate in which the substrate is used to encapsulate a gas. For example, the substrate may be any natural or synthetic material including, but not limited to, plastic, rubber, metal, glass, polymers, and composite.

The term "volume ratio" and "void fraction" as used herein is defined to mean the ratio of total gas volume to gas+non-gas volume of a defined space. For example, a volume ratio may include, but is not limited to, the ratio of total gas volume to substrate volume+gas of an acoustic target.

The term "host structure" as used herein is defined to mean any material into which acoustic targets and/or acoustic suppression systems can be incorporated, to reduce acoustic transmissions through the host structure. A host structure may include anything through which acoustic energy may travel and for which suppression of said acoustic energy is desired. For example, a host structure may include but is not limited to doors, walls, floors, and/or ceilings of building, vehicles, and/or aircrafts, and others. A host structure may also include, but is not limited to materials such as plastic, rubber, metal, glass, polymers, composite, and any other natural or synthetic material.

The term "structural material" as used herein is defined to mean a material that may be used for building or reinforcing a structure. For example, a structural material may include but is not limited to, materials for buildings, houses, and vehicles and may comprise any natural or synthetic material.

The term "containment" as used herein is defined to mean an object that can be used to house/contain acoustic targets and/or bubbles. A containment may constitute part of the acoustic targets and/or bubbles or may be a separate entity. For example, a containment may include, but is not limited to, a host structure, a structural material, and/or any other material that can be used to contain/house acoustic targets and/or bubbles and may comprise the same substrate material as the acoustic targets or may comprise a different substrate material from the acoustic targets.

The present disclosure describes an acoustic suppression system comprising acoustic targets of various sizes, shapes, composition, and distribution, which can change the sound speed due to compressibility of the acoustic targets and thus reduce transmission of the sound through the acoustic suppression system.

Acoustic suppression can be related to impedances as affected by the acoustic targets. Incoherent excitation of the acoustic targets within the acoustic suppression system may absorb and/or scatter sound waves at high frequencies, whereas the coherent excitation of aggregate acoustic targets coupled with incoherent larger size acoustic targets can suppress and scatter sound at low frequencies.

Thus, the present disclosure provides embodiments of an acoustic suppression system which may target a wide range of frequency bands while not requiring an increase in mass of the acoustic suppression system, even when targeting low frequencies.

A mathematical model illustrating the underlying physics is described. The transmission loss factor through a substrate material can be related to its impedance.

Considering a homogeneous acoustic suppression material of thickness L with a plane wave normally incident on its surface, the medium on both sides of the acoustic suppression system can be assumed to be air, with sound speed and density of $C_a$ and $\rho_a$, respectively. Sound speeds and densities of an acoustic suppression system are given by $C_b$ and $\rho_b$ (without acoustic targets) and $C_{bm}$ and $\rho_{bm}$ (with acoustic targets), respectively.

Assuming that incident and reflected waves on the incident side, which for the sake of convenience will be referred to as the "left-hand side", of the acoustic suppression system may be given by [ref 1]:

$$p_i=P_i e^{i(\omega t-k_a x)} \text{ and } p_r=P_r e^{i(\omega t+k_a x)} \quad \text{(Eq. 1)}$$

Transmitted and reflected pressures inside the acoustic suppression system may be given by:

$$p_{bt}=P_{bt} e^{i(\omega t-k_b x)} \text{ and } p_{br}=P_{br} e^{i(\omega t+k_b x)} \quad \text{(Eq. 2)}$$

Transmitted wave on the "right-hand side" of the acoustic suppression system may be given by:

$$p_{bt}=P_{bt} e^{i(\omega t-k_a x)} \quad \text{(Eq. 3)}$$

Continuity of normal acoustic impedances on the "left-hand side" and the "right-hand side" of the acoustic suppression system may lead to the transmitted and reflected pressure waves:

$$\frac{P_t}{P_i} = e^{ik_a L} \Big/ \left[\cos k_b L + i/2\left(\frac{z_a}{z_b} + \frac{z_b}{z_a}\right)\sin k_b L\right] \quad \text{(Eq. 4)}$$

$$\frac{P_r}{P_i} = i\left(\frac{z_b}{z_a} - \frac{z_a}{z_b}\right)\sin k_b L \Big/ 2\left[\cos k_b L + \frac{i}{2\left(\frac{z_a}{z_b} + \frac{z_b}{z_a}\right)\sin k_b L}\right] \quad \text{(Eq. 5)}$$

It should be noted that the terms "left-hand side" and the "right-hand side" as used herein, are used only for convenience of expression for indicating a side of an acoustic suppression system in which sound waves are incident and the opposite side of the acoustic suppression system, in which sound waves may pass through, respectively.

In these equations $Z_a$ and $Z_b$ are impedances, and $k_a=\omega/C_a$ and $k_b=\omega/C_b$, are wave numbers in air and a conventional homogeneous acoustic suppression device. The reflected and transmitted sound pressure levels may be given by for a non unity input pressure:

$$R = \left|\frac{P_r}{P_i}\right| \text{ and } T = \left|\frac{P_t}{P_i}\right|, \quad \text{(Eq. 6)}$$

or in dB given by:

$$R = 20\log\left(\left|\frac{P_r}{P_i}\right|\right) \text{ and } T = 20\log\left(\left|\frac{P_t}{P_i}\right|\right) \quad \text{(Eq. 7)}$$

The acoustic suppression system can be treated by adding a known acoustic target size distribution using the same derivation as above but with wave number $k_b$ now being $k_{bm}$. The wave equation becomes:

$$\Lambda^2 P_{bm}+k_{bm}^2 P_{bm}=0 \quad \text{(Eq. 8)}$$

The wave number in the acoustic suppression system shown in equation 8 can be related to a dispersion relationship given by:

$$k_{bm}^2 = \frac{\omega^2}{c_b^2} + 4\pi\omega^2 \int_0^\infty \frac{Rf(R)dR}{(\omega_0^2 - \omega^2 + 2i\mu\omega)}, \quad \text{(Eq. 9)}$$

where $\omega_0$ represents the acoustic target resonance frequency, R represents the radius of the acoustic target, f(R) is the acoustic target size distribution function, and $\mu$ is the damping in the acoustic suppression system. This equation can be derived based on linearized bubble dynamics [ref 2]. The complex sound speed in the acoustic suppression system may be given by:

$$\frac{c_b^2}{c_{bm}^2} = 1 + 4\pi C_b^2 \int_0^\infty \frac{Rf(R)dR}{(\omega_0^2 - \omega^2 + 2i\mu\omega)} \quad \text{(Eq. 10)}$$

An analysis can be performed with the transmission loss coefficient defined in equation 7 with and without bubbles (i.e. without acoustic targets) in the arrangement with impedances given by $Z_b=\rho_b C_b$ (homogeneous acoustic suppression devices) and $Z_{bm}=\rho_{bm}C_{bm}$ (acoustic suppression system comprising acoustic targets). The wave number $k_b$ and impedance $Z_b$ in equations 4 and 5 are replaced with $k_{bm}$ and $Z_{bm}$ for the acoustic suppression system comprising acoustic targets (i.e. bubbles). The sound speed in the latter is given in equation 10. For example, using the following parameters: sound speed in the acoustic suppression system=1000 m/s, acoustic suppression system density=10 kg/m$^3$, uniform bubble size with radius=1 cm, resonance frequency=600 Hz, and 10,000 bubbles included within the arrangement, theoretical predictions indicate that 5+ dB additional sound reduction can be obtained due to the presence of bubbles (i.e. acoustic targets) at 100 Hz.

In some embodiments, acoustic suppression systems comprise a plurality of acoustic targets, the acoustic targets comprising a substrate material encapsulating a gas, which may serve as bubbles.

The substrate material may comprise any natural or synthetic material with various surface tensions. For example, in an acoustic suppression system, the substrate material and/or surface tension may vary from one acoustic target to another acoustic target or may be the same.

The gas may comprise a single type of atom or molecule or may comprise a mixture of atoms and/or molecules. For example, in an acoustic suppression system, the identity, mixture composition, temperature, pressure, and/or concentration of the gas and/or mixture of gases may vary from one acoustic target to another acoustic target or may be the same.

The acoustic targets may vary in size, shape, and volume. For example, the shapes may include but are not limited to spheres, cylinders, toroids, and discs. For example, in an acoustic suppression system, the shapes of acoustic targets may vary from one acoustic target to another acoustic target or may be the same.

In some embodiments, the acoustic targets have rigid surfaces, wherein the shape of the acoustic target may undergo only minimal distortions upon perturbation.

In some embodiments, the acoustic targets have non-rigid surfaces, wherein the shape of the acoustic target may be easily distorted upon perturbation.

In some embodiments, the acoustic targets may have a total volume $V_T$, a substrate volume $V_{substrate}$, and a gas volume $V_{gas}$ for which volume ratio, $V_R$, can be calculated according to $V_R=V_{gas}/(V_T+V_{substrate})$.

The volume/size of the acoustic target may be based on the targeted frequency range for which acoustic suppression is desired. An average radius of an acoustic target may range from microns to centimeters; in some embodiments, the radius can range up to tens of centimeters.

FIG. 1 shows an acoustic suppression system comprising a plurality of acoustic targets of varying size, shape, and volume (100, 110, 115, 120, 125, 130, 135, and 145) encapsulated in a containment (140) according to some embodiments. For example, a first acoustic target may have a first volume $V_1$, a second acoustic target may have a second volume $V_2$, which may be less than or greater than $V_1$, and a third acoustic target may have a volume $V_3$, which may be less than or greater than $V_1$ and/or $V_2$.

For example, an acoustic suppression system may comprise a plurality of acoustic targets wherein a first acoustic target may comprise a first type of substrate material $SM_1$ with a first surface tension $\gamma_1$ and encapsulating a first type of gas or mixture of gases $G_1$. A second acoustic target may comprise a second type of substrate material $SM_2$, which may be the same as or different from $SM_1$, and encapsulating a second type of gas or mixture of gases $G_2$ that may be, independently from $SM_1$ and/or $SM_2$, the same as or different from $G_1$, and having a surface tension $\gamma_2$ that may be, independently from $SM_1$ and/or $SM_2$ and $G_1$ and/or $G_2$, greater than, less than, or equal to $\gamma_1$.

According to some embodiments, an acoustic suppression system may comprise a plurality of acoustic targets, wherein a first acoustic target has a volume $V_{T1}$ and a second acoustic target has a volume of $V_{T2}$ which may be greater than, less than, or equal to $V_{T1}$.

Figure 2:
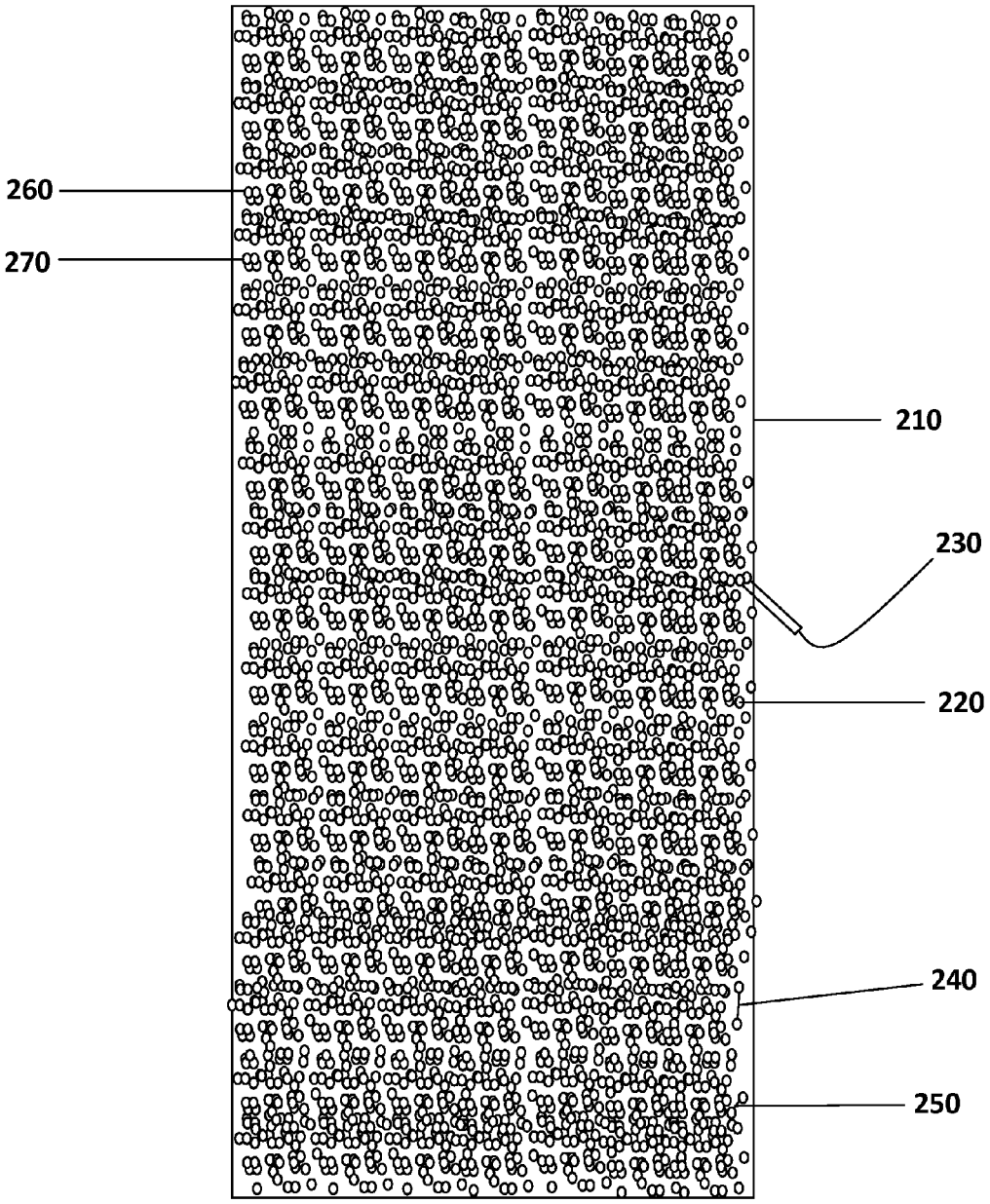
FIG. 2 shows a front-view schematic of an acoustic suppression system according to some embodiments herein described.

FIG. 2 shows an acoustic suppression system comprising a plurality of acoustic targets encapsulated in a containment (210) according to some embodiments, wherein the acoustic targets are relatively uniform in size, shape, and volume (220, 260, 270).

In some embodiments, a plurality of acoustic targets may be packed non-uniformly, i.e. with varying distances between the acoustic targets (150, 155, 160, 230, 240, 250).

FIGS. 3A-E show side-view schematics of acoustic suppression systems comprising acoustic targets, wherein the acoustic targets are encapsulated in a containment to form flexible or rigid acoustic suppression systems of varying thickness and compositions, wherein the acoustic targets may have varying attributes or similar attributes.

FIG. 3A is exemplary of an acoustic suppression system, which is suspended from a host structure (305), wherein the acoustic targets vary in size, shape, and/or volume (310, 320). The acoustic suppression system may be suspended from a host structure by a number of methods. The methods may include, but are in no way limited to, tying down, pinning, screwing, bolting, stapling, and gluing.

FIG. 3B is exemplary of an acoustic suppression system wherein the acoustic targets are incorporated into a host structure (335) and thus do not require an additional containment (315, 360, 380, 397), wherein the host structure has a homogeneous portion (335) configured to enhance strength and a heterogeneous portion (330) comprising acoustic targets of varying size, shape, and volume (325, 340) configured to suppress acoustic energy. For example, a plurality of acoustic targets may be incorporated into a host structure during fabrication of the host structure or may be introduced into the host structure any time after fabrication. This embodiment may also be adapted for use with acoustic targets of relatively uniform size, shape, and/or volume.

FIG. 3C is exemplary of an acoustic suppression system which is attached to a host structure (350) on one side of both the host structure and the acoustic suppression system, the acoustic suppression system comprising acoustic targets of relatively uniform size, shape, and/or volume (345, 355).

FIG. 3D is exemplary of an acoustic suppression system which is attached to a host structure (370, 390) on one side of each of the host structures and both sides of the acoustic suppression system (i.e. the acoustic suppression system is sandwiched between the host structures), the acoustic suppression system comprising acoustic targets of varying size, shape and/or volume (375, 385). This embodiment may also be adapted for use with an acoustic suppression system comprising acoustic targets of relatively uniform size, shape, and/or volume.

The acoustic suppression system in FIGS. 3C and 3D may be attached to a host structure by a number of methods. The methods may include, but are in no way limited to, tying down, pinning, screwing, bolting, stapling, and gluing.

FIG. 3E shows an acoustic suppression system comprising primarily acoustic targets (396, 399), not incorporated into a host structure, but encapsulated in a containment (397), the acoustic suppression system comprising acoustic targets of varying size, shape and/or volume (396, 399). This embodiment may also be adapted for use with an acoustic suppression system comprising acoustic targets of relatively uniform size, shape, and/or volume.

The embodiments of the disclosure can provide acoustic suppression systems that can be used to reduce sound pressure levels and acoustic noise.

In some embodiments, acoustic energy is absorbed by the acoustic targets and transferred into heat energy within the acoustic targets.

In some embodiments, acoustic energy is scattered away by the acoustic targets.

In some embodiments, the acoustic targets can be configured to target a specific range of frequencies based on the attributes of the acoustic targets. The attributes of the acoustic targets that can be used to target a desired frequency range may include, but is not limited to, size, shape, $V_T$, $V_R$, gas identity, gas composition, internal pressure of the acoustic target due to gas pressure, external pressure of the acoustic target, substrate material composition, and/or substrate material surface tension.

In particular, the above-mentioned attributes of the acoustic targets (i.e. size, shape, $V_T$, $V_R$, gas identity, gas composition, internal pressure of the acoustic target due to gas pressure, external pressure of the acoustic target, substrate material composition, and/or substrate material surface tension) can be used to obtain acoustic targets with a particular resonance frequency. When acoustic targets are excited by acoustic waves, the targets can resonate, i.e., the gas may expand and compress. The resonance frequency of each target can be a function of the gas, size, density, and pressure (internal and external pressure of the acoustic target), and the substrate surface tension. The resonant responses of the targets can suppress the sound via conversion to heat energy and scattering.

A method for selecting the attributes of acoustic targets may comprise utilizing high-fidelity mathematical models/numerical solutions and may further comprise performing physical experiments to verify the numerical solutions.

For example, given a particular application, models can be used to provide the optimal sound pressure reduction, both in specified frequency ranges and acoustic levels, and specimen tests may be used to experimentally verify efficacy of a numerical result.

For example, the experiments may include, but are not limited to, the combination of using a transmission loss test using acoustic and anechoic chambers and/or an impedance tube. The results from these tests can aid in a selection of a particular size, shape, $V_T$, $V_R$, gas identity, gas composition, gas pressure, substrate material composition, and/or substrate material surface tension, etc. that should be used to suit a specific application with particular acoustic pressure levels and frequency bands that are to be targeted.

Figure 3:
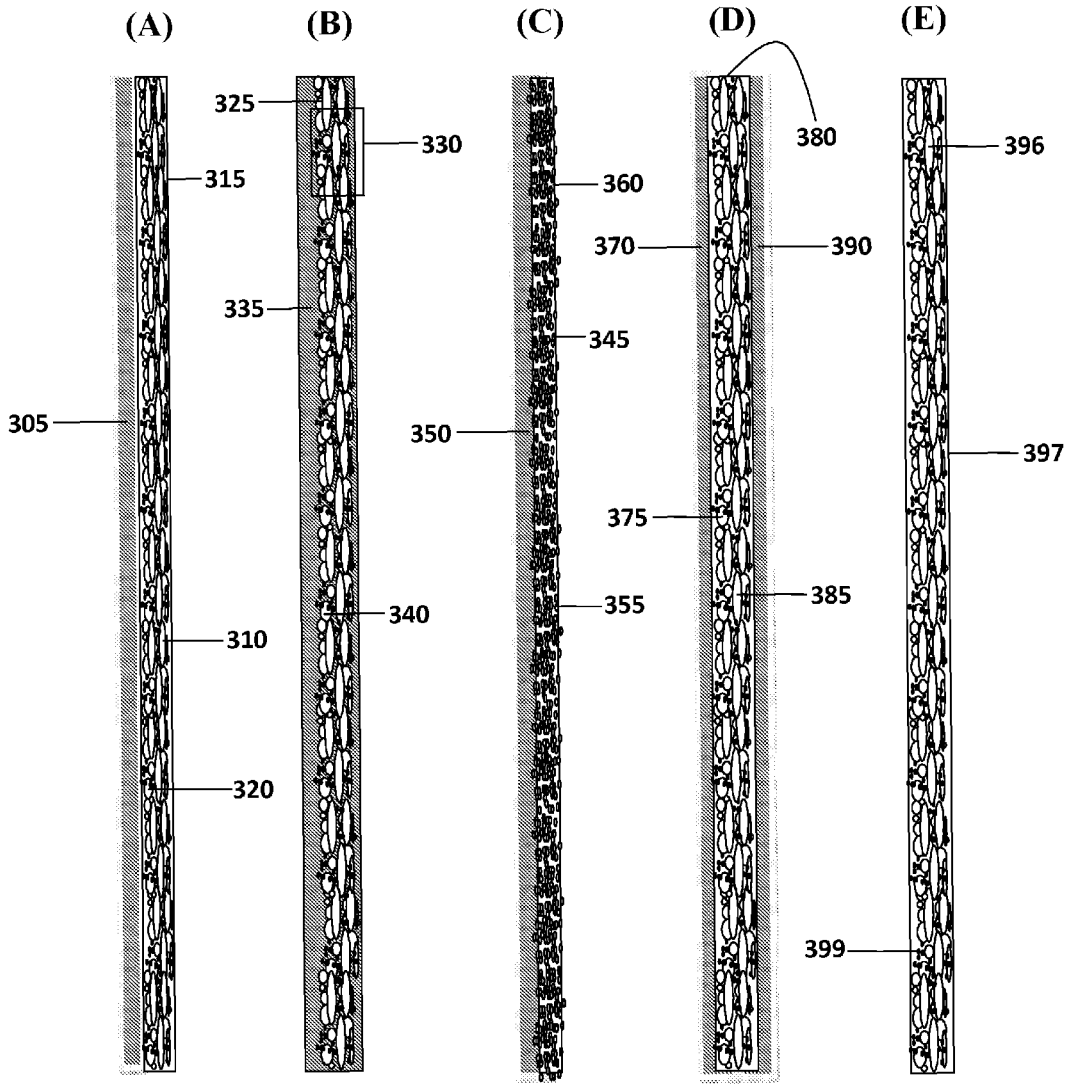
FIGS. 3 (A-E) show side-view schematics of sheets of acoustic suppression systems according to some embodiments herein described.

In the embodiments of FIGS. 1-3, the acoustic suppression systems may comprise acoustic targets with varying attributes or with uniform attributes.

In some embodiments, the acoustic suppression systems can be further configured to target a specific range of frequencies based on the distribution and composition of acoustic targets with various attributes within the acoustic suppression system.

In some embodiments, the acoustic suppression systems can be used for reducing sound pressure in various frequency ranges and in particular can be useful for low frequencies (less than several hundred Hz for most applications) as the acoustic suppression systems herein described provide acoustic suppression at low frequencies without increasing mass. It should be noted that while the ability of the acoustic suppression systems to target low frequencies is advantageous, the embodiments are in no way limited to low frequency ranges and can be fabricated to target a wide range of frequencies.

An acoustic suppression system as described herein can be adapted to provide acoustic suppression for a number of structures. A structure may include but is not limited to doors, walls, floors, and/or ceilings of building, appliances, vehicles, and/or aircrafts or any other transportation systems. This list of structures is not meant to be exhaustive, as a vast number of structures for which acoustic suppression is desired can be envisaged. Furthermore, the acoustic suppression system(s) themselves may serve as a structure.

A method for suppressing acoustic energy may comprise positioning acoustic suppression systems in areas in which acoustic suppression is desired.

Another method for suppressing acoustic energy may comprise stuffing acoustic targets and/or acoustic suppression systems in walls, doors, ceilings, floors, or other structures for which acoustic suppression is desired.

The following serve as just a few specific embodiments of the acoustic suppression system.

In some embodiments, the acoustic suppression systems can be used in the payload area of launch vehicles, wherein the acoustic suppression system is placed in the launch vehicles to absorb and scatter sound and thus reduce sound pressure levels inside the launch vehicle.

In some embodiments, the acoustic suppression systems can be used in fabricating human exploration vehicles where stringent acoustic requirements are in place for a crew cabin module.

In some embodiments, the acoustic suppression systems and/or acoustic targets can be incorporated into a structure such as a door, wall, ceiling, or floor during the fabrication of the structure, or the acoustic suppression systems can be applied to said structure as described, for example, in FIGS. 3 A, C, and D.

EXAMPLES

The following examples are disclosed for further illustration of the embodiments and are not intended to be limiting in any way.

Example 1

Method for Fabricating an Acoustic Suppression System with a Plastic Containment An exemplary method for fabricating an acoustic suppression system with a plastic being the containment is now described. Two regular plastic sheets (1.5×3 meters, ½ mm thick) to serve as the housing for acoustic targets, are sealed on three sides with a plastic sealer. A given volume of gas is pumped into the plastic housing and a fourth side is completely sealed in the same way as the other three sides, resulting in an inflated sealed plastic housing. Several metallic hollow tubes are used to encapsulate bubbles, thereby forming the acoustic targets in the housing, by heating ends of the tubes and pressing them against the inflated plastic housing, bonding the housing where the tubes are pressed. This provides acoustic targets ranging from ½ cm to 3 cm in diameter, which are near spherical. Long cylindrical bubbles are then encapsulated by using a heated cylindrical shaped "branding iron" by pressing against the housing. The resulting acoustic suppression system is approximately 3 cm thick with a void fraction of approximately 80%.

Example 2

Method for Fabricating an Acoustic Suppression System with Plastic Acoustic Targets and a Rubber Containment An exemplary method for fabricating an acoustic suppression system with a rubber containment is now described. Rigid, plastic, hollow spheres are spread in a bed of 1.5×3 meters. Melted rubber is poured into the bed and cooled at room temperature, resulting in an acoustic suppression system with a rubber containment and known acoustic target distribution.

Example 3

Method for Fabricating an Acoustic Suppression System with a Metal Containment

A metal or composite material is melted and a gas is pumped into the metal or composite material to create bubbles, wherein pumping parameters are used to control bubble size, location, and distribution. The melted metal or composite material with trapped bubbles is then hardened under carefully controlled pressure and temperature environments to provide an acoustic suppression system.

The pumping parameters may include, but are not limited to, flow rate of the gas and pressure in a pump. In some embodiments, the flow rate of the gas may range from approximately 0.1 $m^3$/min.-5 $m^3$/min. and the pressure in the pump may range from approximately 5-25 psi, depending on the desired attributes of acoustic targets. The above-mentioned pumping parameters and pumping parameter ranges are given by way of example and not of limitation. One skilled in the art would be able to determine other types pumping parameters and pumping parameters ranges that would provide acoustic suppression systems without departing from the scope of the present disclosure.

It should be noted that these examples, in addition to other methods of fabricating acoustic suppression systems, may be performed manually or by using automated systems.

Example 4

Figure 4:
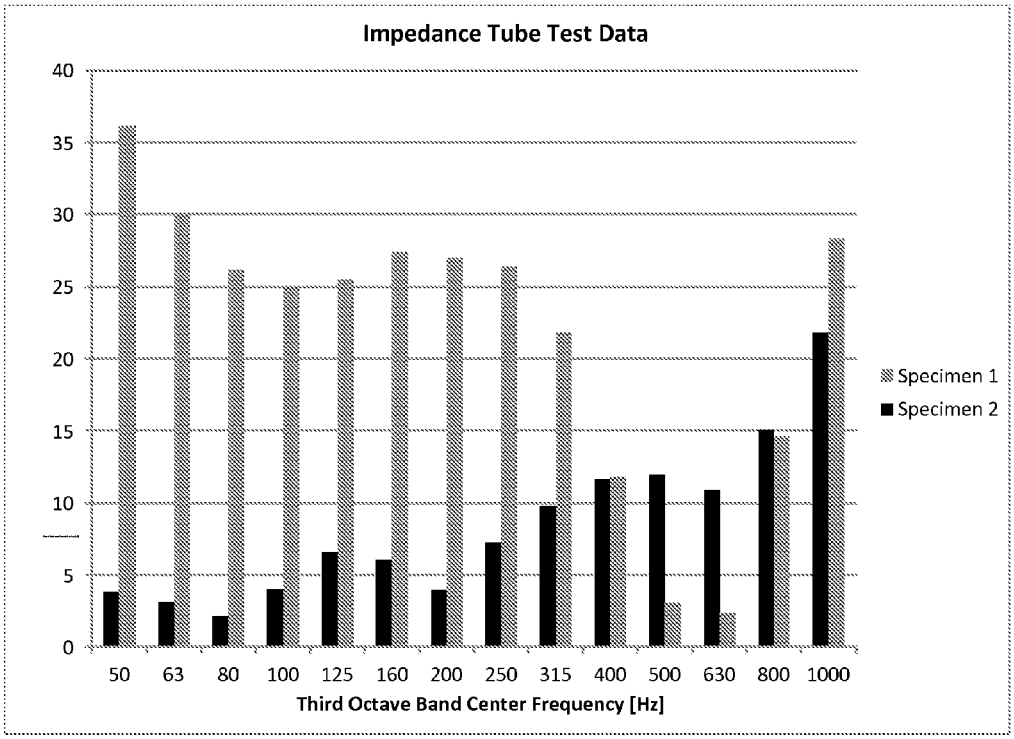
FIG. 4 shows preliminary impedance tube test data for acoustic suppression systems specimen 1 and specimen 2.

Preliminary Test for an Acoustic Suppression System Fabricated to Target a Relatively High Frequency Range Specimen 1 (See FIG. 4) is a 3.5 cm thick disc with a diameter of about 14 cm. Its core is comprised of medium sized (~3-cm diameter), soft, unpressurized acoustic targets. The transmission losses in dB obtained from this specimen placed in an impedance tube are shown in FIG. 4. Specimen 1 displays acoustic reduction of approximately 10-20 dB at higher frequencies.

Example 5

Preliminary Test for an Acoustic Suppression System Fabricated to Target a Low Frequency Range Specimen 2 (See FIG. 4) is a 6.5 cm thick disc with a diameter of about 14 cm. Its core is comprised of five latex-type bubbles with an average size of 6-cm. The transmission losses in dB obtained from this specimen placed in an impedance tube are shown in FIG. 4. Specimen 2 displays acoustic reduction of approximately more than 25 dB reduction in acoustic pressure levels below 400 Hz.

Examples 4 and 5 show example embodiments for suppressing acoustic energy in a particular frequency range by implementing acoustic targets of particular resonance frequencies. It should be noted that an increase in mass of an acoustic suppression system is not necessitated for acoustic suppression systems targeting lower frequencies compared with acoustic suppression systems targeting higher frequencies; the acoustic suppression systems herein described can be of low mass regardless of the targeted frequency range as they comprise acoustic targets, which in turn comprise a substrate material encapsulating a gas. Thus the majority of the mass comes from the substrate material, in particular, from the containment, which can be minimal. An exemplary mass range for acoustic suppression systems of the present disclosure can be between 0.2-0.5 lbs/cubic feet as most of the mass comes from the containment. As a specific example, the low frequency-targeting acoustic suppression system of Example 5 weighs roughly 0.15 lb.

The examples set forth above are provided to give those of ordinary skill in the art a complete disclosure and description of how to make and use the embodiments of the acoustic suppression system of the disclosure, and are not intended to limit the scope of what the inventors regard as their disclosure. Modifications of the above-described modes for carrying out the disclosure can be used by persons of skill in the art, and are intended to be within the scope of the following claims.

All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a", "an", and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

LIST OF REFERENCES

1. Pierce, A. Acoustics: An introduction to its physical principles and applications, Acoustical Society of America, 1991, page 130-133.
2. Properetti, A. A model of bubbly liquid, J. of Wave-Matr. Int., l, 413-432, 1986.

What is claimed is:

1. An acoustic suppression system comprising a containment, in which a plurality of acoustic targets are enclosed, wherein:

each acoustic target comprises a substrate material encapsulating a gas, each acoustic target is configured to have a set resonance frequency allowing the target to be excited by incoming acoustic waves, and setting of resonance frequencies of the plurality of targets is adjustable to suppress acoustic energy in a set frequency range.

2. The acoustic suppression system according to claim 1, wherein the resonance frequency is adjustable based on one or more attributes of the acoustic targets, the attributes selected from the group consisting of size, shape, ratio of substrate material to gas volume, gas identity, gas composition, internal or external pressure, substrate material composition, and/or substrate material surface tension.

3. The acoustic suppression system according to claim 1, wherein the substrate material is a natural or synthetic material.

4. The acoustic suppression system according to claim 1, wherein at least one acoustic target differs from another acoustic target in one or more attributes selected from the group consisting of size, shape, ratio of substrate material to gas volume, gas identity, gas composition, internal or external pressure, substrate material composition, and/or substrate material surface tension.

5. The acoustic suppression system according to claim 1, wherein the acoustic targets are uniform in one or more attributes selected from the group consisting of size, shape, ratio of substrate material to gas volume, gas identity, gas composition, internal or external pressure, substrate material composition, and/or substrate material surface tension.

6. The acoustic suppression system according to claim 1, wherein the containment is suspended from a secondary structure for which acoustic suppression is desired.

7. The acoustic suppression system according to claim 1, wherein the containment is affixed to a secondary structure for which acoustic suppression is desired.

8. The acoustic suppression system according to claim 1, wherein the containment is between two secondary structures for which acoustic suppression is desired and is affixed to the two secondary structures.

9. The acoustic suppression system according to claim 1, wherein the acoustic targets are incorporated directly into a structural material for which acoustic suppression is desired, the structural material serving as the containment, the acoustic suppression system having a homogeneous portion comprising primarily the structural material and a heterogeneous portion comprising the structural material and the acoustic targets.

10. The acoustic suppression system according to claim 1, wherein the acoustic suppression system is adapted to suppress acoustic energy over a low-frequency range.

11. The acoustic suppression system according to claim 10 wherein the low-frequency range is below several hundred Hz.

12. The acoustic suppression system according to claim 1, wherein the acoustic suppression system is adapted to suppress acoustic energy over a mid-frequency range.

13. The acoustic suppression system according to claim 1, wherein the mid-frequency range is from several hundred to a few thousand Hz.

14. The acoustic suppression system according to claim 1, wherein the acoustic suppression system is adapted to suppress acoustic energy over a high-frequency range.

15. The acoustic suppression system according to claim 1, wherein the high-frequency range is above a few thousand Hz.

16. The acoustic suppression system according to claim 1 wherein the acoustic targets are compressible acoustic targets configured to change sound speed through the acoustic suppression system.

17. The acoustic suppression system according to claim 16, wherein the compressible acoustic targets are further configured to reduce transmission of sound through the acoustic suppression system.

18. The acoustic suppression system according to claim 1, wherein the acoustic targets are enclosed in the containment and non-uniformly distributed inside the containment.

19. A method for fabricating an acoustic suppression system, the method comprising placing acoustic targets in a containment, wherein:

each acoustic target comprises a substrate material encapsulating a gas, each acoustic target is configured to have a set resonance frequency allowing the target to be excited by incoming acoustic waves, and setting of resonance frequencies of the plurality of targets is adjustable to suppress acoustic energy in a set frequency range.

20. A method for fabricating the acoustic suppression system according to claim 1, comprising placing the acoustic targets in the containment.

21. A method for fabricating the acoustic suppression system according to claim 1, comprising:

placing acoustic targets into a temporary containment, the acoustic targets having set resonance frequencies;

melting a substrate material;

pouring the melted substrate material into the temporary containment containing the acoustic targets, wherein the substrate material can solidify upon cooling; and cooling the substrate material to form a solid material comprising the acoustic targets, thus providing the acoustic suppression system.

22. A method for fabricating the acoustic suppression system according to claim 1, comprising:

melting a substrate material;

pumping a gas into the melted substrate material to form bubbles, wherein pumping parameters are used to control size, location, and distribution of bubbles; and cooling the melted substrate material to form a solid substrate material comprising the bubbles, the bubbles serving as the acoustic targets having set resonance frequencies, thus providing the acoustic suppression system.

23. A method for fabricating the acoustic suppression system according to claim 1, comprising:

providing a substrate material encapsulating a gas, wherein the substrate material is meltable upon heating;

heating one or more hollow tubes to a temperature capable of melting the substrate material encapsulating the gas, the hollow tubes comprising a material which remains solid upon heating of the hollow tube to a temperature at least commensurate with the melting point of the substrate material encapsulating the gas; and pressing the one or more heated hollow tubes against the substrate material encapsulating the gas to form bubbles and subsequently removing the heated hollow tube to form a plurality of acoustic targets having set resonance frequencies, thus providing the acoustic suppression system.

24. A method for suppressing acoustic energy, the method comprising positioning acoustic suppression systems in areas in which acoustic suppression is desired, the acoustic suppression systems each comprising a containment, in which a plurality of acoustic targets are enclosed, wherein:

each acoustic target comprises a substrate material encapsulating a gas, each acoustic target is configured to have a set resonance frequency allowing the target to be excited by incoming acoustic waves, and setting of resonance frequencies of the plurality of targets is adjustable to suppress acoustic energy in a set frequency range.

25. A method for suppressing acoustic energy, the method comprising positioning acoustic suppression systems according to claim 1, in areas in which acoustic suppression is desired.

26. A method for suppressing acoustic energy, the method comprising stuffing acoustic targets and/or acoustic suppression systems in walls, doors, ceilings, floors, or other structures for which acoustic suppression is desired, wherein:

each acoustic target comprises a substrate material encapsulating a gas, each acoustic target is configured to have a set resonance frequency allowing the target to be excited by incoming acoustic waves, and setting of resonance frequencies of the plurality of targets is adjustable to suppress acoustic energy in a set frequency range.

* * * * *